United States Patent [19]

Nishikawa

[11] Patent Number: 4,524,636

[45] Date of Patent: Jun. 25, 1985

[54] SLOT MACHINE HANDLE LOCKING DEVICE

[75] Inventor: Ikuo Nishikawa, Tochigi, Japan

[73] Assignee: Kabushiki Kaisha Universal, Tochigi, Japan

[21] Appl. No.: 515,353

[22] Filed: Jul. 19, 1983

[30] Foreign Application Priority Data

Jul. 26, 1982 [JP] Japan ..... 57-112185[U]

[51] Int. Cl.[3] ..... G05G 5/06

[52] U.S. Cl. ..... 74/527; 74/577 S

[58] Field of Search ..... 194/9 R, 12, 50, DIG. 11; 273/142 R, 142 HA, 143 R; 74/577 S, 577 M, 527

[56] References Cited

U.S. PATENT DOCUMENTS 4,058,026 11/1977 Simpson ..... 194/DIG. 11

*Primary Examiner*—Stanley H. Tollberg

*Attorney, Agent, or Firm*—Ladas & Parry

[57] ABSTRACT

A device for locking a slot machine handle for causing the rotation of reels until a coin is inserted, is disclosed. When a coin is inserted, a solenoid is activated to move an interlock lever from a first position to a second position. When the interlock lever is in the first position, it holds a locking pawl in engagement with a locking member provided on the same shaft as the handle. When the interlock lever is brought to the second position, it is held in this position until the handle is returned to the initial position. With the interlock lever in the second position, the locking pawl is allowed to be disengaged from the locking member by a spring.

10 Claims, 3 Drawing Figures

SLOT MACHINE HANDLE LOCKING DEVICE

BACKGROUND OF THE INVENTION

This invention relates to a handle locking device for a prize-winning game slot machine.

The slot machine of this type is constructed such that it can be started for a game only after a coin or coins are inserted. Usually, the machine has a handle locking mechanism for preventing the machine from being accidentally started without insertion of a coin into it. In a prior art slot machine handle locking mechanism, a locking member having an engagement section is rotated in unison with the handle, and a locking pawl is adapted to be engaged with and disengaged from the engagement section. The operation of the handle is allowed when the locking pawl is disengaged, i.e., released, by electromagnetic releasing means such as a solenoid which is operated by a signal from a coin insertion detecting section.

In such prior art handle locking device, in which the locking pawl is directly coupled to the solenoid, an inconvenience arises. To be more specific, the slot machine is often operated continuously for playing games in succession. In such a case, usually a coin is inserted for the next start while the handle is not in the initial position but in a more or less pulled state. The insertion of the coin even in this state activates the solenoid. However, the locking pawl is not released but remains locked by the engagement section of the locking pawl by the action of the locking device noted above since an operating force applied to the handle prevails. With the failure of the releasing of the locking pawl, the releasing current continues to be supplied to the solenoid wastefully. This continual current supply is not only wasteful but, in an extreme case, burns out the solenoid coil. It is through to overcome this difficiency by increasing the releasing force of the solenoid. However, the operating force applied to the handle is considerably strong, and the use of a solenoid that can provide a force surpassing the operating force is infeasible. It is also contemplated to arrange such that the current supplied to the solenoid is automatically cut off after the lapse of a predetermined period of time. In this case, however, the handle can no longer be operated from the initial position after the current is cut off unless a new coin is inserted.

SUMMARY OF THE INVENTION

The primary object of the invention, accordingly, is to provide a slot machine handle locking device, with which the electromagnet will never be burnt out even if coins are inserted while the handle is being operated.

Another object of the invention is to provide a slot machine handle locking device, in which once the electromagnet is activated, the handle is rendered ready to be released from the lock irrespective of whether it is in the initial position or being operated.

A further object of the invention is to provide a slot machine handle locking device, which guarantees that a game be started once a predetermined number of coins necessary for the game are inserted.

The above and other objects, features and advantages of the invention are attained by a slot machine handle locking device, in which the locking pawl, unlike the conventional one which is directly operated by a solenoid, is linked to a member operable by a solenoid, and once the solenoid is activated the member operable by the solenoid or a link member linked thereto is held to allow the releasing of the locking pawl from the locking member irrespective of subsequent de-activation of the solenoid.

BRIEF DESCRIPTION OF THE INVENTION

DETAILED DESCRIPTION OF THE INVENTION

Figure 1:
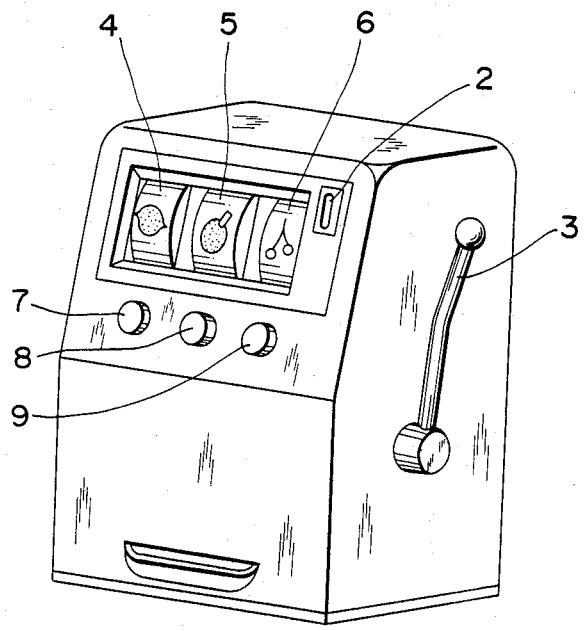
FIG. 1 is a perspective view showing a prize-winning game slot machine.

Referring to FIG. 1, there is shown a prize-winning game slot machine pertaining to the invention. When a coin (or token) is inserted into a coin inlet 2, a handle 3 is released from its locked state. Without any coin inserted, the handle 3 is held locked by a locking mechanism so that it cannot be moved even by applying a pulling force to it. When the handle 3 is pulled after insertion of a coin or coins, juxtaposed reels 4 to 6 are simultaneously caused to rotate by respective pulse motors (not shown). After the rotation of the reels 4 to 6 has been started, the individual reels 4 to 6 can be stopped by depressing corresponding stop buttons 7 to 9.

Figure 2:
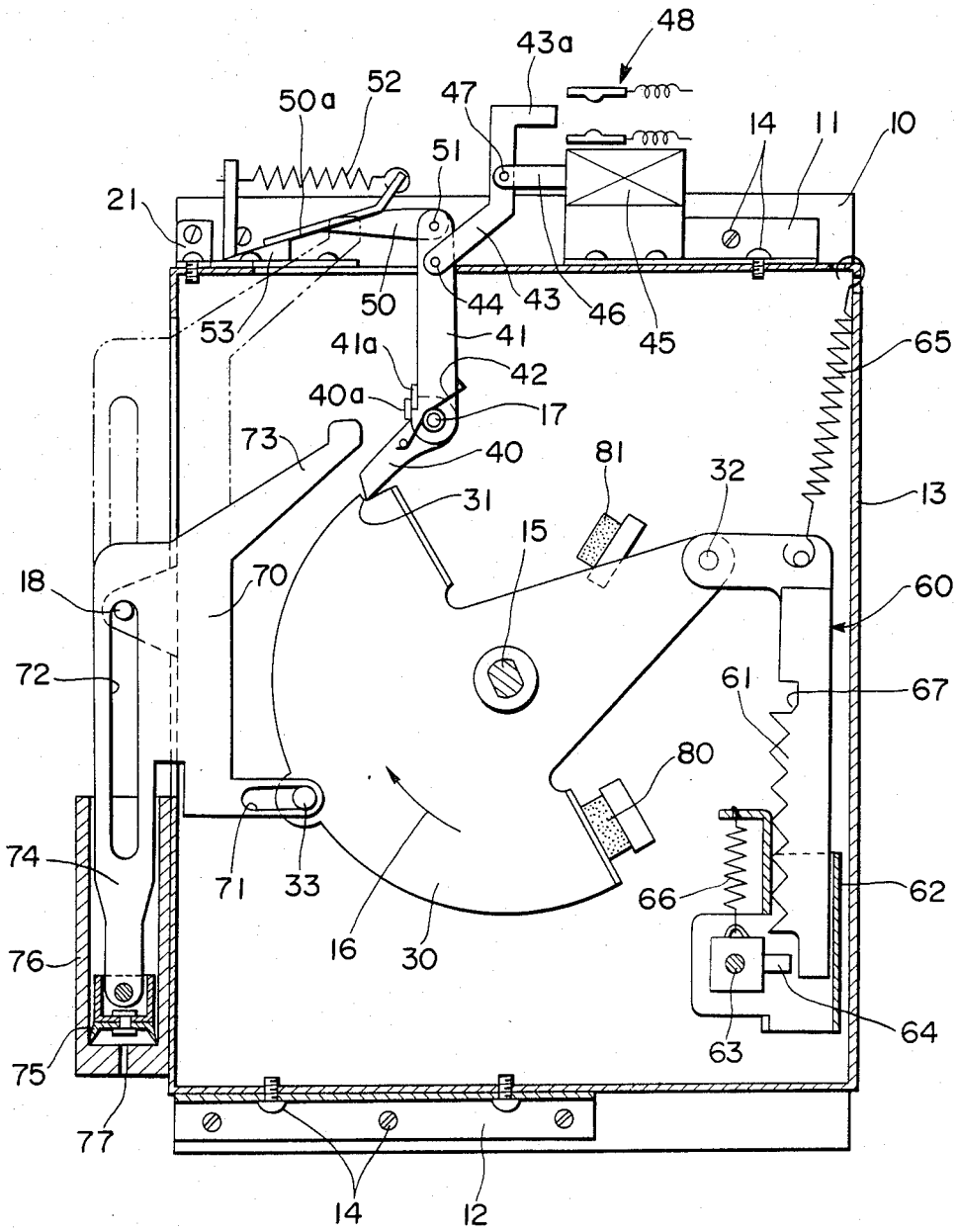
FIG. 2 is a schematic sectional view showing an embodiment of the invention.

An example of the handle locking mechanism is shown in FIG. 2. A base plate 10 is secured to the frame of the slot machine. A substantially box-like frame 13 is secured by bolts 14 to the base plate 10 via L-shaped mounting members 11 and 12. A sector-shaped locking member 30 is secured to a shaft 15, to which the handle 3 is also secured. This assembly is rotated in the direction of arrow 16 for causing the rotation of the reels 4 to 6. The locking member 30 has an engagement section 31, and also it has pins 32 and 33 for pivotably coupling levers to be described later to it. A locking pawl 40 is pivotally mounted on a pin 17 projecting from the base plate 10. It is capable of engagement and disengagement from the engagement section 32 of the locking member 30. An interlock lever 41 is also pivotally mounted on the pin 17. The locking pawl 40 is spring biased in the counterclockwise direction in the Figure about the pin with respect to the interlock lever 41 by a spring 42, which has its opposite ends coupled to the locking pawl 40 and interlock lever 41. The locking pawl 40 and interlock lever 41 respectively have protuberances **40*a* and 41*a*, which constitute a stopper to restrict the pivotal motion of the locking pawl 40. An operating lever 43 is pivotally linked by a pin 44 to an intermediate portion of the interlock lever 41. A solenoid actuator 45 is mounted on the frame 13, and its plunger 46 is linked by a pin 47 to the operating lever 43. It is driven when a coin is put into the slot machine. The operating lever 43 has a top projection 43*a*. When the solenoid actuator 45 is driven, the top projection 43*a* advances into a light path in a photosensor 48, which has a light-emitting and light-receiving section opposing each other. The driving current flowing in the solenoid actuator 45 is interrupted when the light path of the photosensor 48 is clocked by the projection 43*a***.

A locking lever 50 is pivotally coupled by a pin 51 to the upper end of the interlock lever 41. The interlock lever 41 is spring biased in the counterclockwise direction by a spring 52, which has the opposite ends attached to the locking lever 50 and base plate 10 or frame respectively. The locking pawl 40 is thus biased through its protuberance 40*a* in the direction of bringing it into engagement with the engagement section 31. A locking member 53 is mounted on the frame 13, and serves to lock the locking lever 50.

A ratchet arm 60 is pivoted to the pin 32 of the locking member 30. Its ratchet section 61 extends into a ratchet cover 62 and is capable of engaging with a ratchet pawl 64, which is disposed in the ratchet cover 62 and pivoted by a pin 63 to the base plate 10. The ratchet arm 60 is upwardly biased by a spring 65. The ratchet pawl 64 is biased by an operating spring 66.

The pin 33 of the locking member 30 is received in a slot 71 of a cushion arm 70. When the locking member 30 is turned in the direction of arrow 16, the cushion arm 70 is upwardly displaced with a guide of a combination of its slot 72 and a stationary pin 18. It has an oblique extension 73 extending obliquely upwardly and a downward extension 74. It also has a piston 75 made of rubber, for instance, which is provided on the lower end of the downward extension 74. The piston 75 is fitted in a cylinder 76. The cylinder 76 has a small-diameter air passage penetrating its bottom.

Stoppers 80 and 81 are provided to restrict the pivotal motion of the locking member 30. They are preferably made of an elastic material such as rubber to provide for the function of absorbing the impact force.

Figure 3:
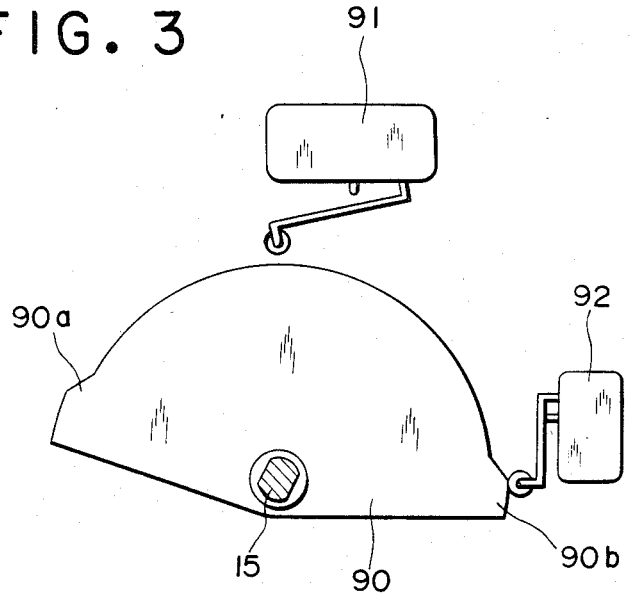
FIG. 3 is a schematic view showing a switch member.

FIG. 3 shows a switch member 90, which is secured to the shaft 15 of the handle 3 on the back side of the base plate 10 of FIG. 2, for instance. The switch member 90 has two cam sections 90*a* and 90*b*. Microswitches 91 and 92 are on-off operated by the respective cam sections 90*a* and 90*b*. The microswitch 91 is turned on when the switch member 90, i.e., the handle 3, is brought to a position corresponding to the end of the pulling stroke. The microswitch 92 is turned on when the handle 3 is brought back to its initial position.

In operation, when a coin is put into the slot machine with the handle 3 in the initial set position, the solenoid actuator 45 is driven, so that the plunger 46 is displaced to the right in FIG. 2. This motion of the plunger causes the interlock lever 41 to be turned about the pin 17 in the clockwise direction via the operating lever 43. With the clockwise rotation of the interlock lever 41, the locking pawl 40 is disengaged from the engagement section 31 of the locking member 30 and retracted. At the same time, the locking lever 50 is moved to the right so that its engagement piece 50*a* gets off of an inclined surface of the locking member 53 and falls into a held portion. The interlock lever 41 is now held locked in this position against the restoring force of the spring even if the solenoid actuator 45 is rendered inoperative with the advancement of the top projection 43*a* of the operating lever 34 into the photosensor 48 caused by the action of the solenoid actuator 45. The locking pawl 40 is thus held in its retreated position, so that the handle 3 is ready to be operated. It is to be appreciated that the locking pawl 40 can be held locked in the released position without any continual current through the solenoid 45.

The operation will now be described in connection with the case when coins are inserted while the handle 3 is being operated. With the conventional device, problems are prevented in such a case as described earlier. In this embodiment, the locking member 30 is biased in the direction of arrow 16, with its engagement section 31 in formed engagement with the locking pawl 40. When a coin or coins are inserted, the interlock lever 41 is turned clockwise regardless of whether the locking pawl 40 is in engagement or not for the plunger 46 is coupled to the locking pawl 40 not directly but via the operating lever 43 and interlock lever 41. The subsequent advancement of the projection 43*a* of the operating lever 43 into the photosensor 48 causes de-energization of the solenoid as described previously. The interlock lever 41, however, is not returned but is held in the rotated position since the engagement piece 50*a* of the locking lever 50 is locked. This means that the locking pawl 40 is ready to be released clockwise by the biasing force of the spring 42, that is, it can be released immediately when the operating force applied to the handle 3 is removed or reduced.

The handle 3 now can be pulled forth. By pulling it, the locking member 30 is rotated in the direction of arrow 16, thus raising the cushion arm 70 and lowering the ratchet arm 60. As the ratchet arm 60 is lowered, the ratchet pawl 64 progressively engages successive ratchets of the ratchet section 61. Thus, the handle 3 will never be returned from an intermediate position to the initial position even by removing or reducing the operating force at that position. As the cushion arm 70 is raised, air is introduced into the cylinder 70 through the air passage 77.

When the handle 3 is pulled until the microswitch 91 is turned on by the cam section 90*a* of the switch member 90, the pulse motors for driving the reels 4 to 6 are started. Immediately after or simultaneously with the start of the pulse motors, the locking member 30 is brought into engagement with the stopper 81. At this instant, the oblique extension 73 of the cushion arm 70 is brought to a position shown by the phantom lines. As a result, the engagement piece 50*a* gets off of the shoulder or upright surface of the locking member 53, whereupon the locking lever 50 is pulled back to the left by spring force of the spring 52. At the same time, the interlock lever 41 is returned to the initial position. Now, the interlock lever 41 and locking pawl 40 are operatively coupled with their protuberances 41*a* and 40*a* in engagement with each other. That is, the locking pawl 40 is urged against the periphery of the locking member 30 by the spring 52, so that it is ready for engagement with the engagement section 31.

When the handle 3 is pulled for the full stroke, the ratchet pawl 64 is engaged in a notch 67 in the ratchet arm 60. At this time, it is turned upwards by the pulling force of the spring 66. In this state it allows the return of the ratchet arm 60. That is, by removing the pulling force from the handle in this state, the handle is returned in unison with the locking member 30 to the initial position by the spring 65.

In the slot machine of the type concerned, the handle is usually adapted to be operated with a comparatively great force. In such case, the handle is apt to be returned suddenly by removing or reducing the operating force. In this embodiment, the piston 75 and cylinder 76 constitute a buffer providing an adequate resistance against the restoration of the locking member 30 in unison with the handle 3. In other words, the handle 3 can be returned somewhat slowly despite a strong handle restoration spring force because air in the cylinder 76 is pushed out through the narrow air passage 77 with the descent of the piston 75.

When handle 3 is returned to the initial position, the engagement section 31 of the locking member 30 is engaged by the locking pawl 40, so that the handle 3 is locked and prevented from being operated again without insertion of a coin. With the restoration of the handle 3 to the initial position, the microswitch 92 is turned on by the cam section 90*b*, so that it is ready to stop the reels 4 to 6 by operating the stop button 7 to 9. After the reels 4 to 6 are all stopped, a coin pay-out mechanism is operated according to the displayed combination of symbols of the reels 4 to 6. When this operation is completed, the individual driving sections and circuit sections are brought to the initial stationary state.

In the above embodiment, cushion arm 70 is utilized for releasing the locking lever 50 from the lock, but it is possible to use any other releasing means as well, for instance, a solenoid operable by an electric signal from the microswitch 91.

Various further changes and modifications of the embodiment are possible without departing from the scope and spirit of the invention.

What is claimed is:

1. In a slot machine handle locking device for locking a slot machine handle for determining the instant of start of rotation of a plurality of reels and also functioning to release the lock of the handle and permit operation thereof so as to cause rotation of the reels when a coin is inserted, an improvement comprising:

a locking member rotatable in unison with said handle and having an engagement section;

a locking pawl movable between an initial locked position in engagement with said engagement section and a position out of engagement therewith;

an interlock lever movable between a first and second position, said locking pawl being held in said locked position when said interlock lever is in said first position;

a spring for biasing said locking pawl toward said out-of-engagement position so that said locking pawl can move following said interlock lever;

an electromagnet for moving said interlock lever to said second position;

locking means for locking said interlock lever in said second position against restoration to said first position when said interlock lever is brought to said second position; and releasing means for releasing said locking means from a locked state when said locking pawl is returned to said initial locked position in engagement with said locking pawl.

2. The slot machine handle locking device according to claim 1, wherein said locking member is secured to a shaft of said handle.

3. The slot machine handle locking device according to claim 2, wherein said electromagnet is a solenoid.

4. The slot machine handle locking device according to claim 3, which further comprises a sensor for detecting the movement of said interlock lever to said second position to thereby de-energize said solenoid.

5. The slot machine handle locking device according to claim 4, wherein said sensor is a photosensor.

6. The slot machine handle locking device according to claim 5, wherein said engagement section is a notch formed in the outer periphery of said locking member.

7. The slot machine handle locking device according to claim 6, wherein said locking pawl and interlock lever are rotatable mounted on the same pin and have respective protuberance adapted to engage with each other to prevent the rotation of said locking pawl to said out-of-engagement position.

8. The slot machine handle locking device according to claim 7, wherein said spring has one end attached to said locking pawl and the other end attached to said interlock lever.

9. The slot machine handle locking device according to claim 8, wherein said releasing means is a lever coupled to said locking member and adapted to push said interlock lever so as to release the lock thereof by said locking means when said locking member is returned to said initial locked position.

10. In a slot machine handle locking device for locking a slot machine handle for determining the instant of start of game when a coin is inserted, an improvement comprising:

a locking member rotatable in unison with said handle and having an engagement section;

a locking pawl movable between an initial locked position in engagement with said engagement section and a position out of engagement therewith;

an interlock lever movable between a first and second position, said locking pawl being held in said locked position when said interlock lever is in said first position;

a spring for biasing said locking pawl toward said out-of-engagement position so that said locking pawl can move following said interlock lever;

an electromagnet for moving said interlock lever to said second position;

locking means for locking said interlock lever in said second position against restoration to said first position when said interlock lever is brought to said second position; and releasing means for releasing said locking means from a locked state when said locking pawl is returned to said initial locked position in engagement with said locking pawl.

* * * * *